US008890900B2

(12) United States Patent
Kwon et al.

(10) Patent No.: US 8,890,900 B2
(45) Date of Patent: Nov. 18, 2014

(54) LIQUID CRYSTAL DISPLAY AND METHOD OF LOCAL DIMMING THEREOF

(75) Inventors: Kyungjoon Kwon, Seoul (KR); Injae Chung, Gyeonggi-do (KR); Euiyeol Oh, Seoul (KR)

(73) Assignee: LG Display Co., Ltd., Seoul (KR)

( * ) Notice: Subject to any disclaimer, the term of this patent is extended or adjusted under 35 U.S.C. 154(b) by 349 days.

(21) Appl. No.: 12/848,437

(22) Filed: Aug. 2, 2010

(65) Prior Publication Data

US 2011/0122171 A1 May 26, 2011

(30) Foreign Application Priority Data

Nov. 24, 2009 (KR) ..... 10-2009-0113985

(51) Int. Cl.
*G09G 5/10* (2006.01)
*G09G 3/34* (2006.01)
*G09G 3/36* (2006.01)

(52) U.S. Cl.
CPC ..... *G09G 3/342* (2013.01); *G09G 3/3648* (2013.01); *G09G 2320/0646* (2013.01)
USPC ..... 345/690; 345/102; 315/169.3

(58) Field of Classification Search
CPC ..... G09G 2320/0646; G09G 2360/16; G09G 2320/0233; G09G 3/3648; G09G 3/3406; G09G 2320/0242; G09G 2320/0626
USPC ..... 345/76–104, 204–215, 690–699; 315/169.1–169.4
See application file for complete search history.

(56) References Cited

U.S. PATENT DOCUMENTS

| | | | | |
|---|---|---|---|---|
| 7,394,448 | B2 * | 7/2008 | Park et al. | 345/102 |
| 8,111,223 | B2 * | 2/2012 | Yeo et al. | 345/82 |
| 2007/0110158 | A1 * | 5/2007 | Maeda | 375/240.16 |
| 2007/0152926 | A1 * | 7/2007 | Kwon | 345/82 |
| 2008/0174612 | A1 * | 7/2008 | Someya et al. | 345/690 |

(Continued)

FOREIGN PATENT DOCUMENTS

| | | | |
|---|---|---|---|
| KR | 10-2008-0059799 | A | 7/2008 |
| KR | 10-2008-0105897 | A | 12/2008 |
| KR | 10-2009-0081804 | A | 7/2009 |

OTHER PUBLICATIONS

Office Action dated Oct. 2, 2012 from the Korean Patent Office in a counterpart Korean application.

(Continued)

*Primary Examiner* — Abbas Abdulselam
*Assistant Examiner* — Gerald Oliver
(74) *Attorney, Agent, or Firm* — Morgan, Lewis & Bockius LLP

(57) ABSTRACT

A liquid crystal display includes a display panel, a backlight unit providing light to the display panel, a representative value adjusting unit that divides an input image in conformity with a plurality of blocks divided from the display panel and a light emitting surface of the backlight unit, selectively adjusts a representative value of each block based on a luminance difference between the blocks and a grayscale banding degree of each block, and generates a modified representative value of each block, a dimming value determining unit that maps the modified representative value of each block to a predetermined dimming curve and selects a dimming value of each block, and a light source driver for driving light sources of the backlight unit based on the dimming value of each block.

4 Claims, 8 Drawing Sheets

(56) References Cited

U.S. PATENT DOCUMENTS

| | | | | |
|---|---|---|---|---|
| 2009/0015755 | A1 | 1/2009 | Bang et al. | |
| 2009/0147105 | A1* | 6/2009 | Du et al. | 348/234 |
| 2009/0184917 | A1 | 7/2009 | Park et al. | |
| 2009/0189543 | A1 | 7/2009 | Yeo et al. | |
| 2009/0273558 | A1 | 11/2009 | Lee | |
| 2010/0060675 | A1* | 3/2010 | Ko et al. | 345/691 |
| 2010/0149086 | A1* | 6/2010 | Choi | 345/102 |
| 2010/0149428 | A1* | 6/2010 | Kishimoto | 348/725 |
| 2011/0069078 | A1* | 3/2011 | Zhang et al. | 345/589 |

OTHER PUBLICATIONS

Office Action dated Aug. 9, 2013 from the Taiwan Patent Office in counterpart Taiwanese application No. 099125447.

* cited by examiner

| | Dimming curve #1 | Dimming curve #2 |
|---|---|---|
| Power consumption(WH) | 188Wh(22% reduction) | 118Wh(51% reduction) |

LIQUID CRYSTAL DISPLAY AND METHOD OF LOCAL DIMMING THEREOF

This application claims the benefit of Korea Patent Application No. 10-2009-0113985 filed on Nov. 24, 2009, the entire contents of which is incorporated herein by reference for all purposes as if fully set forth herein.

BACKGROUND OF THE INVENTION

1. Field of the Invention

Exemplary embodiment of the invention relates to a liquid crystal display and a local dimming method thereof.

2. Discussion of the Related Art

A range of application for liquid crystal displays has gradually widened because of its excellent characteristics such as light weight, thin profile, and low power consumption. A backlit liquid crystal display controls an electric field applied to a liquid crystal layer and modulates light coming from a backlight unit, thereby displaying an image.

The image quality of the liquid crystal display depends on contrast characteristics. It is limited to an improvement of the contrast characteristics using only a method for controlling a data voltage applied to a liquid crystal layer of a liquid crystal display panel to modulate a light transmittance of the liquid crystal layer. Accordingly, a backlight dimming method for controlling a luminance of a backlight unit based on an input image is developed so as to improve the contrast characteristics, and thus greatly improves the contrast characteristics. The backlight dimming method adaptively controls the luminance of the backlight unit based on the input image to thereby reduce power consumption. The backlight dimming method includes a global dimming method for controlling a luminance of an entire display surface of the liquid crystal display panel and a local dimming method for locally controlling a luminance of a display surface of the liquid crystal display panel by dividing the display surface into a plurality of blocks.

The global dimming method may improve a dynamic contrast measured between two successively arranged frame periods. The local dimming method locally controls the luminance of the display surface during one frame period, thereby improving a static contrast that is difficult to improve using the global dimming method.

The local dimming method divides the backlight unit into the plurality of blocks to make a backlight luminance of a block corresponding to a bright image high, and to make a backlight luminance of a block corresponding to a relatively dark image low. Because the plurality of blocks each including light sources are individually turned on in the local dimming method, the backlight luminance in the local dimming method is less than a backlight luminance measured when all of the light sources of the backlight unit are turned on. To compensate for the low backlight luminance in the local dimming method, pixel data is multiplied by a predetermined gain, and thus can be compensated. In the local dimming method, when the pixel data is compensated, there occurs the grayscale band phenomenon, in which high gray levels look like the same brightness. Hence, the image quality degradation may be generated. For a reduction in the image quality degradation, a dimming curve for selecting a dimming value based on a representative value of each block may use a dimming curve, in which most of gray levels increase. In this case, an improvement effect of the image quality can be obtained. However, because the dimming values mapped to most of the representative values of the blocks increase, a reduction effect of the power consumption is not satisfactory.

SUMMARY OF THE INVENTION

Exemplary embodiments of the invention provide a liquid crystal display and a local dimming method thereof capable of greatly reducing power consumption in local dimming and improving the image quality.

In one aspect, there is a liquid crystal display comprising a display panel, a backlight unit configured to provide light to the display panel, a representative value adjusting unit configured to divide an input image in conformity with a plurality of blocks divided from the display panel and a light emitting surface of the backlight unit, selectively adjust a representative value of a each block based on a luminance difference between the each block and the blocks around the each block and a grayscale band of each block to generate a modified representative value of each block, wherein the gray scale band is shown when high gray levels look like same brightness, a dimming value determining unit configured to map the modified representative value of the each block to a predetermined dimming curve and select a dimming value of the each block, and a light source driver configured to drive light sources of the backlight unit based on the dimming value of the each block.

The liquid crystal display further comprises a first representative value calculating unit configured to calculate the representative value of the each block based on the input images divided in conformity with the each block, and a second representative value calculating unit configured to calculate an entire representative value of the input image corresponding to one frame.

The representative value adjusting unit includes a first representative value adjusting unit configured to adjust a representative value of a specific block to an estimate value determined depending on a difference between the representative value of the specific block and the entire representative value, a second representative value adjusting unit configured to determine a weight value depending on the grayscale band of the specific block, and an adding unit configured to add the weight value to the representative value of the each block and output the modified representative value of the each block.

The liquid crystal display further comprises a light amount calculating unit for each pixel configured to select a predetermined light profile using the dimming value of the each block and calculate an amount of light of each of pixels of the specific block, a gain adjusting unit configured to calculate a gain of each pixel of the specific block based on the amount of light of each pixel of the specific block, multiply the gain of each pixel by pixel data, and output compensation values of the pixel data of the specific block, and an image quality evaluating unit configured to calculate the grayscale band of the specific block based on the compensation values of the pixel data of the specific block and input the grayscale band to the second representative value adjusting unit.

In another aspect, there is a local dimming method of a liquid crystal display comprising dividing a display panel and a light emitting surface of a backlight unit into a plurality of blocks, dividing an input image in conformity with the plurality of blocks, selectively adjusting a representative value of a each block based on a luminance difference between the each block and the blocks around the each block and a grayscale band of each block to generate a modified representative value of each block, wherein the gray scale band is shown when high gray levels look like same brightness, mapping the modified representative value of the each block to a predetermined dimming curve to determine a dimming value of the each block, and driving light sources of the backlight unit based on the dimming value of the each block.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
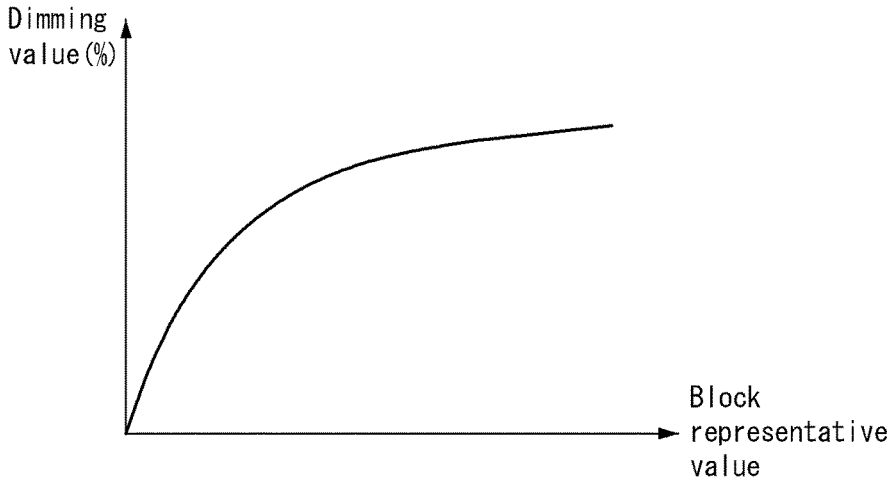
FIG. 1 illustrates an example of a high dimming curve.

The invention will be described more fully hereinafter with reference to the accompanying drawings, in which example embodiments of the inventions are shown. This invention may, however, be embodied in many different forms and should not be construed as limited to the embodiments set forth herein. Like reference numerals designate like elements throughout the specification. In the following description, if it is decided that the detailed description of known function or configuration related to the invention makes the subject matter of the invention unclear, the detailed description is omitted.

Names of elements used in the following description are selected in consideration of facility of specification preparation. Thus, the names of the elements may be different from names of elements used in a real product.

Before exemplary embodiments of the invention are described, changes in the image quality and changes in power consumption depending on the compensation or non-compensation of pixel data and a type of selected dimming curve in a local dimming method are described with reference to FIGS. 1 to 4C.

The local dimming method divides a display screen into a plurality of blocks, obtains a representative value of an input image corresponding to each block, maps the representative value of each block to a dimming curve, and selects a dimming value (unit: %) of each block. The representative value of each block may be calculated by an average value of the input image or an average picture level (APL). The average value of the input image is an average value of maximum values among R, G, and B values in each pixel. The APL is an average value of luminance values Y of the pixels. The dimming curve is expressed by a characteristic operation equation defining a dimming value to be applied to a corresponding block based on the representative values of the blocks, and may be previously set to a lookup table.

Figure 2:
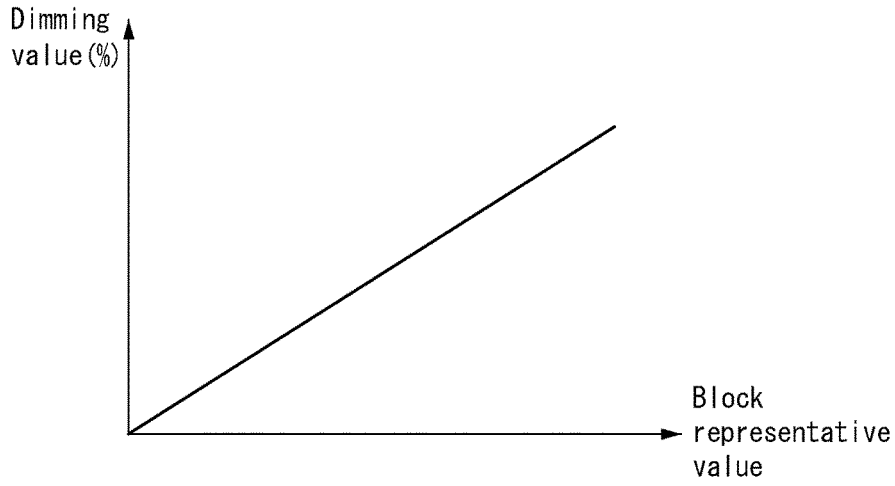
FIG. 2 illustrates an example of a low dimming curve.

The dimming curve may be selected by one of a high dimming curve shown in FIG. 1 and a low dimming curve shown in FIG. 2. In FIGS. 1 and 2, a horizontal axis is a representative value of each block, and a vertical axis is a dimming value. In the high dimming curve shown in FIG. 1, as a gray level increases, the dimming value exponentially increases. In the low dimming curve shown in FIG. 2, as a gray level increases, the dimming value linearly increases. Thus, the dimming value of the high dimming curve shown in FIG. 1 is greater than the dimming value of the low dimming curve shown in FIG. 2 over almost all of gray levels. The increase of the dimming value results in an increase in a driving power of a backlight unit, and thus the power consumption increases. The low dimming curve shown in FIG. 2 is more advantageous to the power consumption than the high dimming curve shown in FIG. 1, but may reduce the image quality as shown in FIGS. 3A to 4C.

Figure 3A:
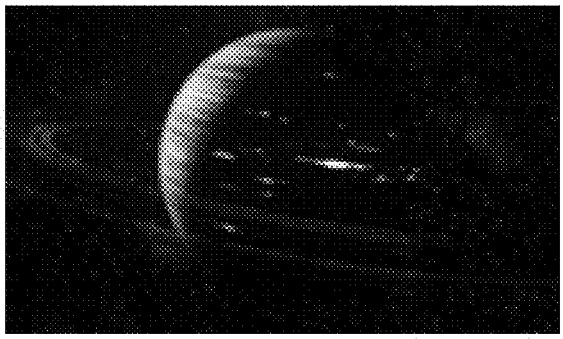
FIGS. 3A to 3C are images of the result of an experiment conducted using a high dimming curve and a low dimming curve when pixel data is not compensated in a local dimming method.
Figure 3B:
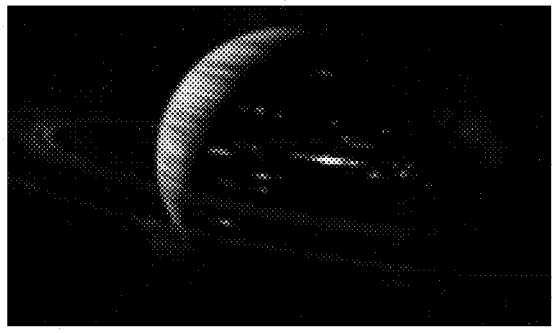
Figure 3C:
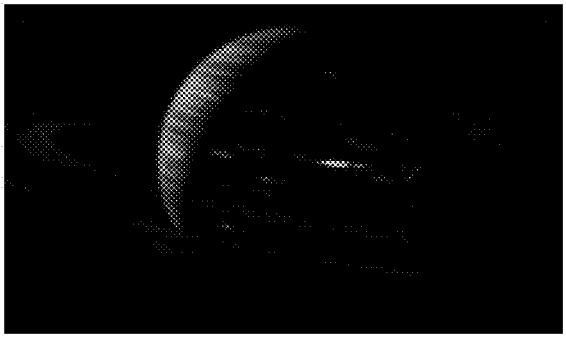

FIGS. 3A to 3C are images of the result of an experiment conducted using a high dimming curve and a low dimming curve when pixel data is not compensated in a local dimming method.

As shown in FIG. 3B, a representative value of each block in an original image shown in FIG. 3A is mapped to the high dimming curve shown in FIG. 1 to select a dimming value of each block, and a backlight luminance of each block is controlled based on the dimming value. When the pixel data is not compensated, an entire luminance of a display image shown in FIG. 3B decreases. On the other hand, as shown in FIG. 3C, the representative value of each block in the original image shown in FIG. 3A is mapped to the low dimming curve shown in FIG. 2 to select a dimming value of each block, and a backlight luminance of each block is controlled based on the dimming value. When the pixel data is not compensated, an entire luminance of a display image shown in FIG. 3C further decreases, and a minute portion of the display image is not displayed. Accordingly, when the pixel data is not compensated in the local dimming method, the high dimming curve shown in FIG. 1 is more advantageous to the image quality than the low dimming curve shown in FIG. 2, but is disadvantageous to the power consumption than the low dimming curve shown in FIG. 2.

Figure 4A:
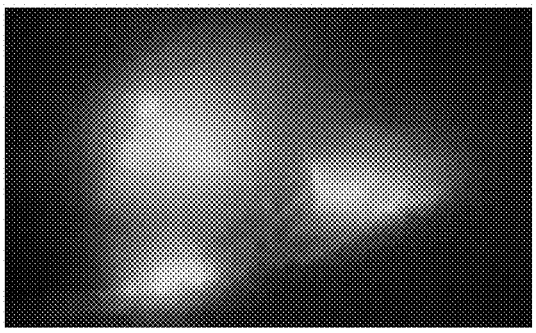
FIGS. 4A to 4C are images of the result of an experiment conducted using a high dimming curve and a low dimming curve when pixel data is compensated in a local dimming method.
Figure 4B:
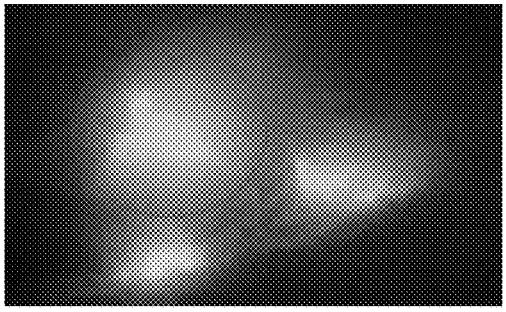
Figure 4C:
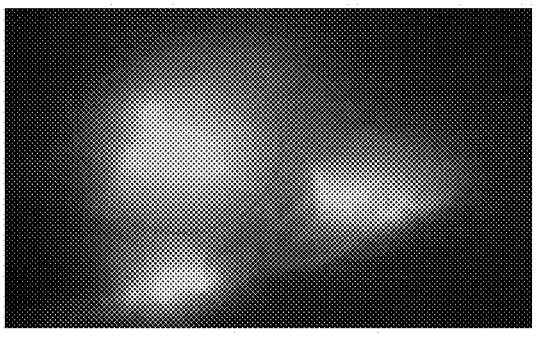

FIGS. 4A to 4C are images of the result of an experiment conducted using a high dimming curve and a low dimming curve when pixel data is compensated in a local dimming method.

As shown in FIG. 4B, a representative value of each block in an original image shown in FIG. 4A is mapped to the high dimming curve shown in FIG. 1 to select a dimming value of each block, and a backlight luminance of each block is controlled based on the dimming value. When the pixel data is compensated, a grayscale band phenomenon, in which high gray levels look like at the same luminance, appears in a bright portion of a circle shown in FIG. 4B because of an overcompensation of the pixel data. On the other hand, as shown in FIG. 4C, the representative value of each block in the original image shown in FIG. 4A is mapped to the low dimming curve shown in FIG. 2 to select a dimming value of each block, and a backlight luminance of each block is controlled based on the dimming value. When the pixel data is compensated, the grayscale band worsens in a bright portion of a circle shown in FIG. 4C because of an overcompensation of the pixel data. Accordingly, when the pixel data is compensated in the local dimming method, the high dimming curve shown in FIG. 1 is more advantageous to the image quality than the low dimming curve shown in FIG. 2, but is disadvantageous to the power consumption than the low dimming curve shown in FIG. 2.

The exemplary embodiment of the invention performs the local diming based on the low dimming curve shown in FIG. 2, that is advantageous to the power consumption, and adjusts the representative value of each block of the input image in conformity with a determined rule, thereby improving the image quality.

Figure 5:
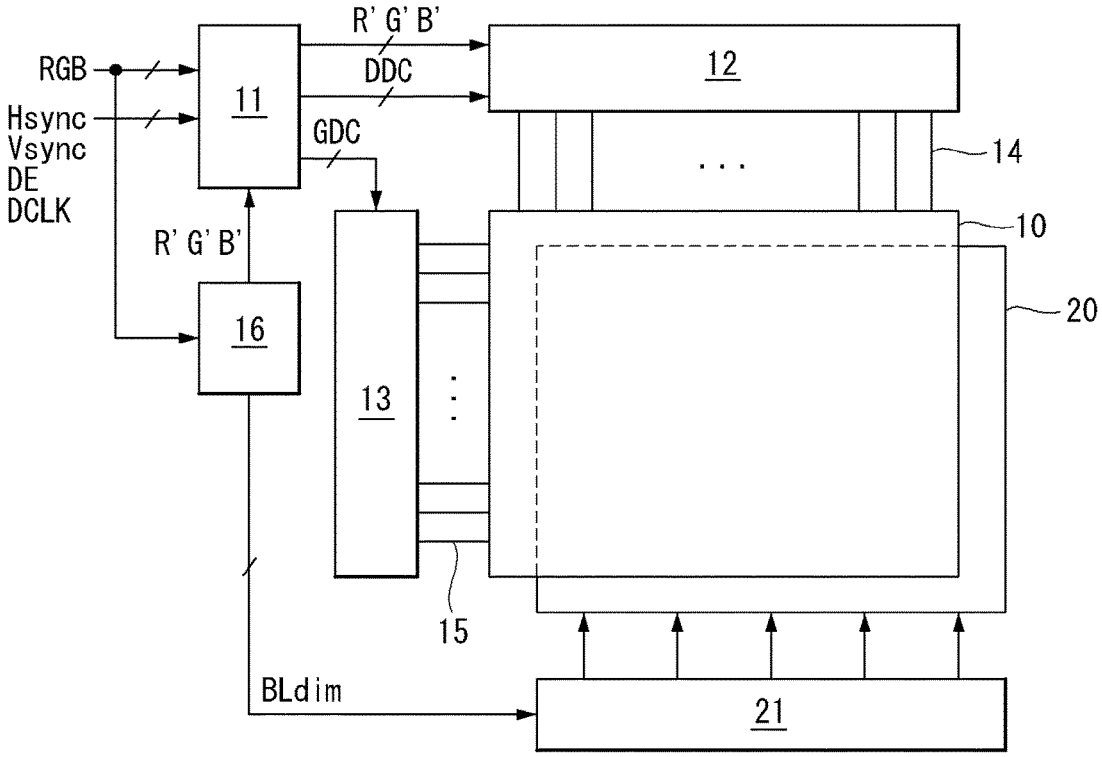
FIG. 5 is a block diagram of a liquid crystal display according to an exemplary embodiment of the invention.
Figure 6:
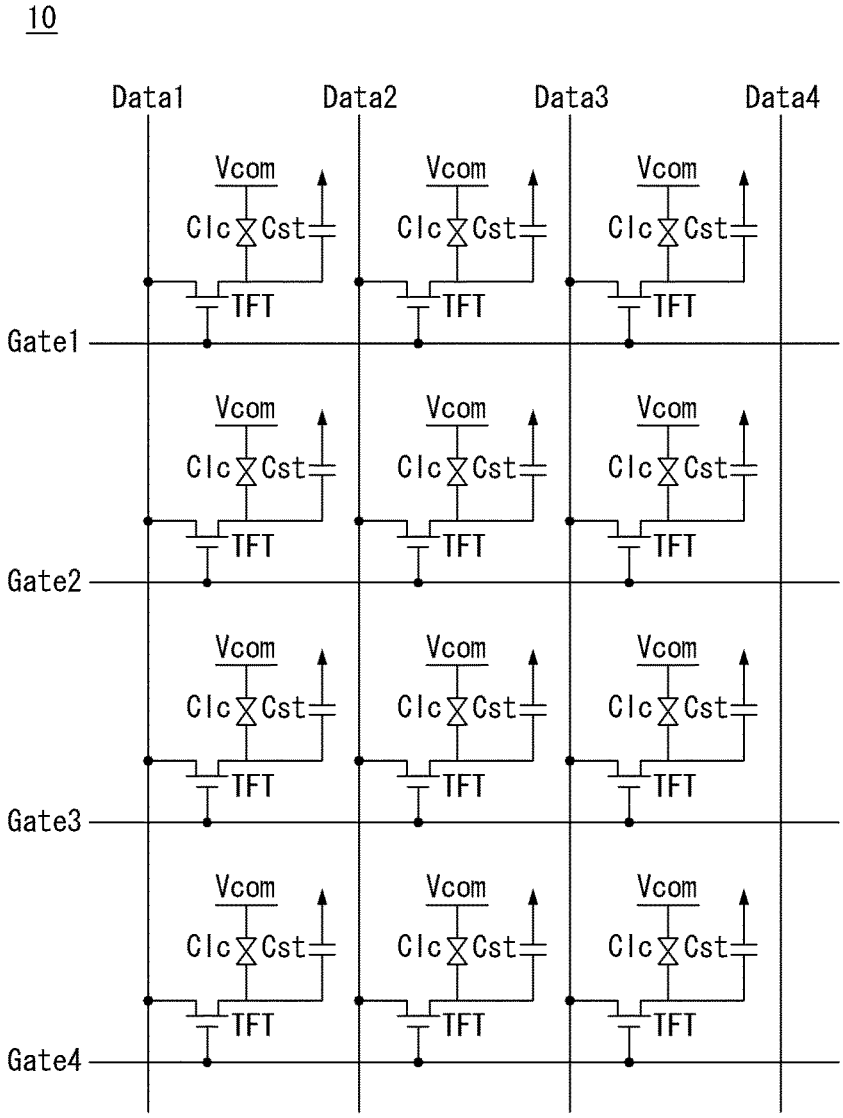
FIG. 6 is an equivalent circuit diagram of a portion of a pixel array of a liquid crystal display panel shown in FIG. 5.
Figure 7:
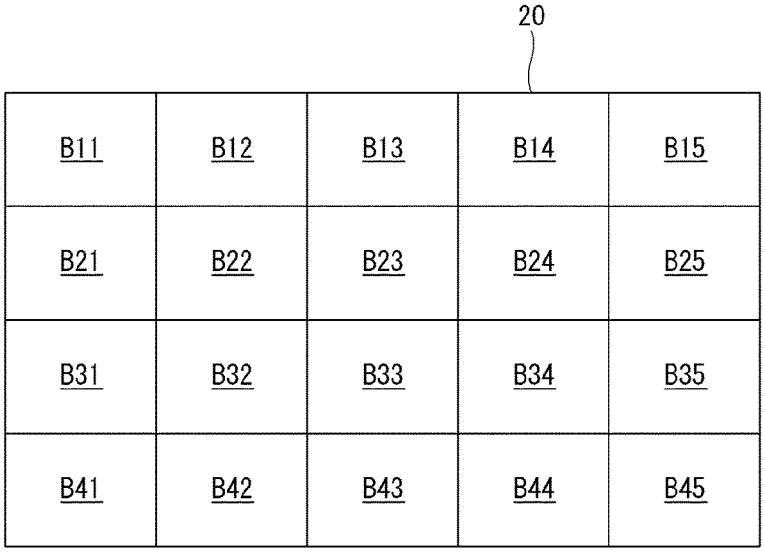
FIG. 7 illustrates a plurality of blocks for local dimming.

FIGS. 5 to 7 illustrate a liquid crystal display according to an exemplary embodiment of the invention.

As shown in FIGS. 5 to 7, a liquid crystal display according to an exemplary embodiment of the invention includes a liquid crystal display panel 10, a source driver 12 for driving data lines 14 of the liquid crystal display panel 10, a gate driver 13 for driving gate lines 15 of the liquid crystal display panel 10, a timing controller 11 for controlling the source driver 12 and the gate driver 13, a backlight unit 20 providing light to the liquid crystal display panel 10, a light source driver 21 for driving light sources of the backlight unit 20, and a local dimming controller 16 for controlling local dimming.

The liquid crystal display panel 10 includes an upper glass substrate, a lower glass substrate, and a liquid crystal layer between the upper and lower glass substrates. The plurality of data lines 14 and the plurality of gate lines 15 cross one another on the lower glass substrate of the liquid crystal display panel 10. As shown in FIG. 6, a plurality of liquid crystal cells Clc are arranged on the liquid crystal display panel 10 in a matrix form in accordance with a crossing structure of the data lines 14 and the gate lines 15. The data lines 14, the gate lines 15, thin film transistors TFT, pixel electrodes of the liquid crystal cells Clc connected to the thin film transistors TFT, storage capacitors Cst, and the like are formed on the lower glass substrate of the liquid crystal display panel 10.

A black matrix, a color filter, and a common electrode are formed on the upper glass substrate of the liquid crystal display panel 10. In a vertical electric field drive manner such as a twisted nematic (TN) mode and a vertical alignment (VA) mode, the common electrode is formed on the upper glass substrate. In a horizontal electric field drive manner such as an in-plane switching (IPS) mode and a fringe field switching (FFS) mode, the common electrode and the pixel electrode are formed on the lower glass substrate. Polarizing plates are respectively attached to the upper and lower glass substrates of the liquid crystal display panel 10. Alignment layers for setting a pre-tilt angle of liquid crystals are respectively formed on the inner surfaces contacting the liquid crystals in the upper and lower glass substrates.

As shown in FIG. 7, a pixel array of the liquid crystal display panel 10 and a light emitting surface of the backlight unit 20 opposite the pixel array are divided into a plurality of blocks B11 to B45 for local diming Each of the blocks B11 to B45 includes i×j pixels, where i and j are a positive integer equal to or greater than 2, and a backlight light emitting surface providing light to the i×j pixels. Each pixel includes subpixels of three primary colors, and each subpixel includes one liquid crystal cell Clc.

The timing controller 11 receives timing signals Vsync, Hsync, DE, and DCLK from an external system board and supplies digital video data RGB to the source driver 12. The timing signals Vsync, Hsync, DE, and DCLK include a vertical sync signal Vsync, a horizontal sync signal Hsync, a data enable signal DE, and a dot clock DCLK. The timing controller 11 generates a source timing control signal DDC and a gate timing control signal GDC for respectively controlling operation timings of the source driver 12 and the gate driver 13 based on the timing signals Vsync, Hsync, DE, and DCLK received from the external system board. The external system board or the timing controller 11 inserts an interpolation frame between frames of an input video signal input at a frame frequency of 60 Hz and multiplies the frequency of the source timing control signal DDC by the frequency of the gate timing control signal GDC. Hence, the timing controller 11 can control operations of the source driver 12 and the gate driver 13 at a frame frequency of (60×N) Hz, where N is a positive integer equal to or greater than 2.

The timing controller 11 supplies the digital video data RGB of an input image received from the external system board to the local dimming controller 16 and supplies digital video data R'G'B' modulated by the local dimming controller 16 to the source driver 12.

The source driver 12 latches the digital video data R'G'B' under the control of the timing controller 11. The source driver 12 converts the digital video data R'G'B' into positive and negative analog data voltages using positive and negative gamma compensation voltages and supplies the positive/negative analog data voltages to the data lines 14.

The gate driver 13 includes a shift register, a level shifter for converting an output signal of the shift register into a swing width suitable for a TFT drive of the liquid crystal cells, an output buffer, and the like. The gate driver 13 includes a plurality of gate driver integrated circuits (ICs). Each of the plurality of gate driver ICs sequentially outputs a gate pulse (or a scan pulse) having a pulse width of about one horizontal period and sequentially supplies the gate pulse to the gate lines 15 in synchronization with the data voltage supplied to the data lines 14.

The backlight unit 20 is positioned under the liquid crystal display panel 10 and includes a plurality of light sources. The plurality of light sources are divided into a plurality of blocks, and the plurality of blocks each the light sources are individually controlled by the light source driver 21. Hence, the backlight unit 20 can uniformly provide light to the liquid crystal display panel 10. The backlight unit 20 may be one of an edge type backlight unit and a direct type backlight unit. The light sources of the backlight unit 20 may include one or two of a hot cathode fluorescent lamp (HCFL), a cold cathode fluorescent lamp (CCFL), an external electrode fluorescent lamp (EEFL), and a light emitting diode (LED).

The light source driver 21 individually controls the plurality of blocks each including the light sources using a pulse width modulation (PWM) signal whose a duty ratio (unit: %) varies depending on a dimming value BLdim received from the local dimming controller 16. The PWM signal controls turn-on and turn-off percentages of the light sources, and the duty ratio of the PWM signal is determined based on the dimming value BLdim received from the local dimming controller 16.

As shown in FIG. 7, the local dimming controller 16 analyzes the digital video data RGB of each block received from the timing controller 11 and calculates a representative value of each block. The local dimming controller 16 maps the representative value of each block to the low dimming curve of FIG. 2 and outputs the dimming value BLdim of each block of the backlight unit 20. The local dimming controller 16 modulates the digital video data RGB received from the timing controller 11 and compensates for pixel data to be displayed on the liquid crystal display panel 10. The local dimming controller 16 forecasts an image of a block, in which the image quality will be reduced when the low dimming curve of FIG. 2 is applied, in conformity with the predetermined rule. Thus, when the image of the block in which the image quality will be reduced is input, the local dimming controller 16 increases the representative value of the image quality reduction block and adjusts the dimming value BLdim of the image quality reduction block.

Figure 8:
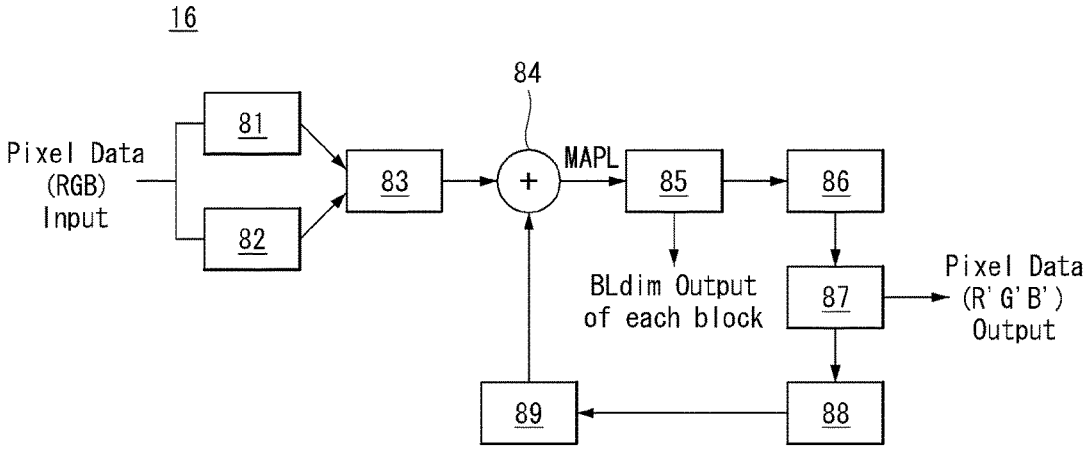
FIG. 8 is a block diagram showing in detail a local dimming controller shown in FIG. 5.

FIG. 8 is a block diagram showing in detail the local dimming controller 16 shown in FIG. 5. As shown in FIG. 8, the local dimming controller 16 includes a first representative value calculating unit 81, a second representative value calculating unit 82, a first representative value adjusting unit 83, an adding unit 84, a dimming value determining unit 85, a light amount calculating unit 86, a gain correcting unit 87, a image quality evaluating unit 88, and a second representative value adjusting unit 89.

The first representative value calculating unit 81 calculates a representative value of each block of an input image. The second representative value calculating unit 82 calculates an entire representative value of the input image corresponding to one frame. The representative value of each block and the entire representative value are calculated by the average value of the input image or the APL.

Figures 11, 12:
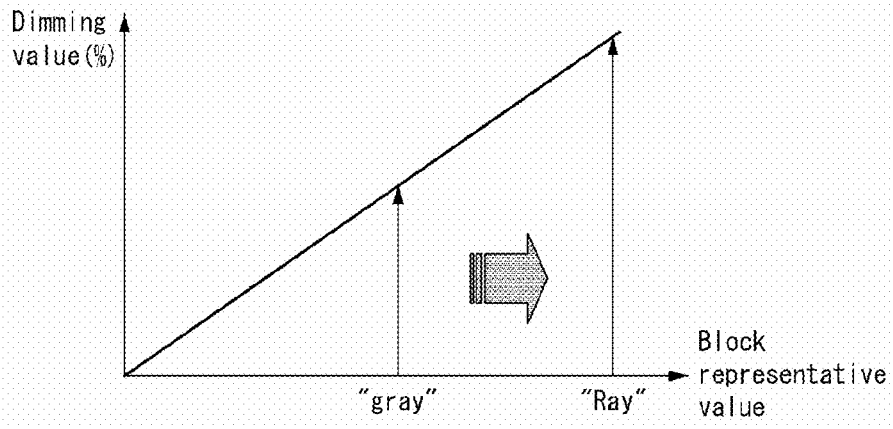
FIG. 11 illustrates an example of adjusting a representative value of each block.
FIG. 12 illustrates the result of an experiment comparing a reduction effect of power consumption when local dimming is performed using a high dimming curve of FIG. 1 with a reduction effect of power consumption when local dimming is performed using a low dimming curve of FIG. 11.

When the local dimming is performed on a specific block, whose a representative value is greater than the entire representative value, based on the representative value of the specific block, the screen darkness or the grayscale band may be generated in the specific block because of low luminances of blocks around the specific block. The first representative value adjusting unit 83 selectively adjusts the representative value of the specific block through the following process in consideration of the screen darkness or the grayscale band. The first representative value adjusting unit 83 calculates a difference between a representative value of the specific block and the entire representative value. As shown in FIG. 11, the first representative value adjusting unit 83 adjust the representative value of the specific block to a estimate value based on the difference between the representative value of the specific block and the entire representative value. The estimate value is determined through an experiment and increases as the difference between the representative value of the specific block and the entire representative value increases.

The adding unit 84 adds the representative value of the specific block received from the first representative value adjusting unit 83 to a weight value from the second representative value adjusting unit 89 and outputs a modified representative value of the specific block.

The dimming value determining unit 85 maps the modified representative value of the specific block to a low dimming curve shown in FIG. 11, selects a dimming value BLdim of the specific block, and outputs the dimming value BLdim of the specific block to the light source driver 21 and the light amount calculating unit 86 for each pixel. The dimming value determining unit 85 may select the dimming value BLdim of the specific block using a lookup table. The lookup table receives the modified representative value of each block, addresses the modified representative value of each block, selects the dimming value BLdim of each block from a previously stored dimming curve, and outputs the dimming value BLdim of each block. The light source driver 21 controls a luminance of the light sources of the backlight unit 20 of each block in response to the dimming value BLdim of each block using the PWM signal.

The light amount calculating unit 86 selects a predetermined light profile using the dimming value BLdim of each block and calculates an amount of light of each pixel in the specific block. The light profile may be calculated by a sum of an amount of light of a specific pixel in the local dimming and an amount of light required to reach from pixels around the specific pixel to the specific pixel. The light profile may be determined through an experiment in which the local dimming is performed using the dimming value BLdim of each block and a luminance of each pixel is measured.

The gain correcting unit 87 calculates a gain of each pixel and multiplies the gain of each pixel by original pixel data, thereby compensating for the pixel data. The gain is calculated by a ratio of an amount of light of a pixel in non-local dimming (i.e., when all of the light sources of the backlight unit 20 are turned on in a full-white pattern or at a maximum brightness) to an amount of light of a pixel calculated through the light profile in local dimming In other words, the gain G may be calculated to be $G=K_{normal}/K_{local}$. In the above equation, $K_{normal}$ is a constant indicating a backlight luminance when the local dimming is not performed and is a constant indicating the luminance of the full-white pattern. $K_{local}$ is a variable indicating an amount of light of the specific block based on the dimming value BLdim of each block when the local dimming is performed.

The image quality evaluating unit 88 analyzes compensation values of pixel data of the specific block received from the gain correcting unit 87, calculates a grayscale banding degree, and output a grayscale band estimate value. The image quality evaluating unit 88 calculates the number of data with a white gray level among the compensation values of the pixel data of the specific block. A gray level of the pixel data may be determined as most significant bit (MSB). For example, the pixel data may be determined as data with the white gray level when MSB is "11", the pixel data may be determined as data with a black gray level when MSB is "00", and the pixel data may be determined as data with a middle gray level when MSB is "01". The image quality evaluating unit 88 decides that the grayscale band appears in the specific block when the number of data with the white gray level is greater than a predetermined reference value. The image quality evaluating unit 88 decides that the grayscale band does not appear in the specific block when the number of data with the white gray level is less than the predetermined reference value. The grayscale band estimate value calculated by the image quality evaluating unit 88 increases as the number of data with the white gray level increases.

The second representative value adjusting unit 89 selects the weight value depending on the grayscale band estimate value received from the image quality evaluating unit 88 and feedback input the weight value to the adding unit 84. The second representative value adjusting unit 89 may be implemented by a lookup table selecting the weight value depending on the grayscale band estimate value or an operation logic circuit calculating the weight value depending on the grayscale band estimate value. The weight value may vary in proportion to the grayscale band estimate value.

Figure 9:
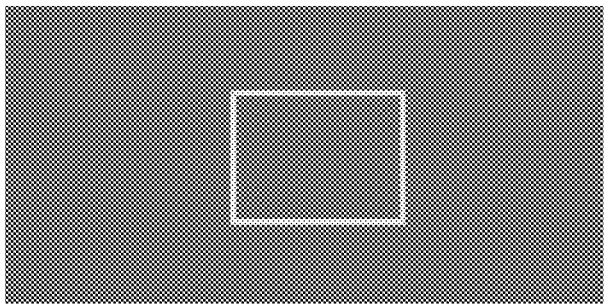
FIGS. 9 and 10 are images of the result of an experiment comparing a related art local dimming method with a local dimming method according to an exemplary embodiment of the invention.
Figure 10:
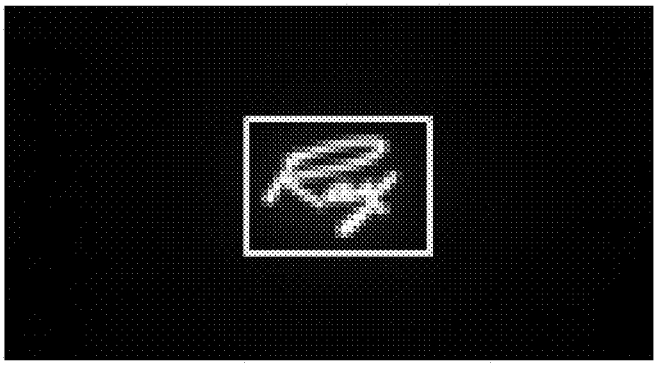

An example of the local dimming according to the exemplary embodiment of the invention is described below with reference to FIGS. 9 to 11. FIG. 9 illustrates a first image in which pixels of the entire screen are pixel data with the middle gray level. FIG. 10 illustrates a second image in which there is a background darker than the first image and a bright letter "Ray" is written in a middle portion at a luminance of the white gray level. In FIGS. 9 and 11, an image of a box in the middle of each of the first and second images is assumed as a specific block.

The specific block of FIG. 9 and the specific block of FIG. 10 have the same APL of '127'. In the related art local dimming method, the local dimming is performed on the specific block of FIG. 9 and the specific block of FIG. 10 using the same dimming value (i.e., a dimming value mapped to a representative value "gray" in FIG. 11) because the specific blocks of FIGS. 9 and 10 have the same representative value, namely, the same APL. In this case, the grayscale band in which similar white gray levels look like the same gray level, is generated in the specific block of FIG. 10 because of a grayscale saturation resulting from a low dimming value and a sum of the compensation values of the pixel data. On the other hand, in the local dimming method according to the exemplary embodiment of the invention, the image displayed on the specific block of FIG. 10 is analyzed, a difference between a luminance of the specific pixel and luminances of pixels around the specific pixel and a grayscale banding degree in the specific pixel are estimated, and a low representative value (i.e., the dimming value mapped to the representative value "gray" of FIG. 11) of the specific block increases to a dimming value mapped to a representative value "Ray" of FIG. 11. Hence, a reduction in the image quality of the specific block of FIG. 10 is prevented. The image quality evaluating unit 88 increases the representative value of the specific block until the number of data with the white gray level is equal to or less than the predetermined reference value (i.e., until the grayscale band disappears).

FIG. 12 illustrates the result of an experiment comparing a reduction effect of the power consumption when the local dimming is performed using the high dimming curve ("Dimming curve #1" of FIG. 12) of FIG. 1 with a reduction effect of the power consumption when the local dimming is performed using the low dimming curve ("Dimming curve #2" of FIG. 12) of FIG. 11.

In the experiment, the power consumption was measured in a non-local dimming state in which an experimental image is displayed on the liquid crystal display when the local dimming is not performed and all of the light sources of the backlight unit 20 are turned on in the full-white pattern. The power consumption in the related art local dimming method was measured when the same experimental image is displayed on the same liquid crystal display while the local diming is performed using the high dimming curve ("Dimming curve #1" of FIG. 12) of FIG. 1 and the plurality of blocks each including the light sources are individually controlled. Further, the power consumption in the local dimming method according to the exemplary embodiment of the invention was measured through the same process as the related art local dimming method except that the low dimming curve ("Dimming curve #2" of FIG. 12) of FIG. 11 is used. The power consumption in the related art local dimming was reduced by 22% of the power consumption in the non-local dimming, and the power consumption according to the exemplary embodiment of the invention was reduced by 51% of the power consumption in the non-local dimming.

Accordingly, the exemplary embodiment of the invention can greatly reduce the power consumption using the low dimming curve ("Dimming curve #2" of FIG. 12) of FIG. 11. Further, as described above, the exemplary embodiment of the invention estimates the luminance difference between the specific block and the blocks around the specific block and the grayscale banding degree of the specific block and adaptively increases the representative value of the specific block, thereby increasing the image quality in the local dimming.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

a display panel;

a backlight unit configured to provide a backlight to the display panel;

a first representative value calculating unit configured to calculate a representative value of each block based on an input image of a current frame divided in conformity with each block;

a second representative value calculating unit configured to calculate an entire representative value of the input image of the current frame;

a first representative value adjusting unit configured to adjust a representative value of a specific block of the current frame to an estimate value determined depending on a difference between the representative value of the specific block and the entire representative value;

a second representative value adjusting unit configured to determine a weight value depending on a grayscale band of the specific block, wherein the grayscale band appears in the block when the number of data with white gray level in the specific block is greater than a predetermined reference value;

an adding unit configured to add the weight value of the specific block to the representative value of the specific block and output a modified representative value of the specific block;

a dimming value determining unit configured to map the modified representative value of the specific block to a predetermined dimming curve and select a dimming value for controlling a backlight luminance of the specific block; and a light source driver configured to drive light sources of the backlight unit based on the dimming value of the specific block.

2. The liquid crystal display of claim 1, further comprising:

a light amount calculating unit for the each pixel configured to select a predetermined light profile using the dimming value of the specific block and calculate an amount of light of each of pixels of the specific block;

a gain adjusting unit configured to calculate a gain of each pixel of the specific block based on the amount of light of each pixel of the specific block, multiply the gain of each pixel by pixel data, and output compensation values of the pixel data of the specific block; and an image quality evaluating unit configured to calculate the grayscale band of the specific block based on the compensation values of the pixel data of the specific block and input the grayscale band to the second representative value adjusting unit.

3. A local dimming method of a liquid crystal display comprising:

dividing a display panel and a light emitting surface of a backlight unit into a plurality of blocks;

dividing an input image of a current frame in conformity with the plurality of blocks;

calculating a representative value of each block based on an input image of the current frame divided in conformity with the each block;

calculating an entire representative value of the input image of the current frame;

adjusting a representative value of a specific block of the current frame to an estimate value determined depending on a difference between the representative value of the specific block and the entire representative value;

determining a weight value depending on a grayscale band of the specific block, wherein the grayscale band appears in the specific block when the number of data with white gray level in the block is greater than a predetermined reference value;

adding the weight value of the specific block to the representative value of the specific block to output a modified representative value of the specific block;

mapping the modified representative value of the specific block to a predetermined dimming curve to determine a dimming value for controlling a backlight luminance of the specific block; and driving light sources of the backlight unit based on the dimming value of the specific block.

4. The local dimming method of claim 3, further comprising:

selecting a predetermined light profile using the dimming value of the specific block and calculating an amount of light of each of pixels of the specific block;

calculating a gain of each pixel of the specific block based on the amount of light of each pixel of the specific block, multiplying the gain of each pixel by pixel data, and generating compensation values of the pixel data of the specific block; and calculating the grayscale band of the specific block based on the compensation values of the pixel data of the specific block.

* * * * *